US006499423B2

(12) United States Patent
Mills

(10) Patent No.: US 6,499,423 B2
(45) Date of Patent: Dec. 31, 2002

(54) CIVILIAN—MILITARY—AVIATION TIME CONVERSION DEVICE

(76) Inventor: William E. Mills, 6349 N. 78th St., Unit 71, Scottsdale, AZ (US) 85250

( * ) Notice: Subject to any disclaimer, the term of this patent is extended or adjusted under 35 U.S.C. 154(b) by 0 days.

(21) Appl. No.: 09/927,234

(22) Filed: Aug. 11, 2001

(65) Prior Publication Data

US 2002/0021623 A1 Feb. 21, 2002

Related U.S. Application Data

(60) Provisional application No. 60/224,535, filed on Aug. 11, 2000.

(51) Int. Cl.[7] ..... G09F 9/00
(52) U.S. Cl. ..... 116/308; 368/21
(58) Field of Search ..... 116/308, 306, 116/307, 309, 311, 312, 315, 316, 317; 368/21, 22, 10, 276, 284, 222, 221, 26

(56) References Cited

U.S. PATENT DOCUMENTS

| | | | | | |
|---|---|---|---|---|---|
| 1,709,700 | A | * | 4/1929 | Wishinsky | 368/284 |
| 1,830,102 | A | * | 11/1931 | Felsenthal | 40/334 |
| 1,959,831 | A | * | 5/1934 | Krzeminski | 368/26 |
| 2,262,818 | A | * | 11/1941 | Reese | 40/334 |
| 3,002,337 | A | * | 10/1961 | Smith | 368/21 |
| 4,182,059 | A | * | 1/1980 | Greene | 40/377 |
| 4,215,531 | A | * | 8/1980 | Wong | 368/10 |
| 4,336,882 | A | * | 6/1982 | Sakwa | 206/537 |
| 4,681,460 | A | * | 7/1987 | Nishimura | 368/21 |
| 4,909,178 | A | * | 3/1990 | Le Brocq | 116/28 R |
| 5,007,033 | A | * | 4/1991 | Kubota et al. | 368/21 |
| 5,017,034 | A | * | 5/1991 | Stary et al. | 401/35 |

FOREIGN PATENT DOCUMENTS

GB 2 132 391 A * 7/1984

* cited by examiner

*Primary Examiner*—Diego Gutierrez
*Assistant Examiner*—Tania C. Courson
(74) *Attorney, Agent, or Firm*—Jeffrey D. Moy; Harry M. Weiss; Weiss, Moy & Harris, P.C.

(57) ABSTRACT

A time conversion device has a body section having a table of time zones printed thereon. A tubular sleeve is provided and fits over the body section. The tubular sleeve has a fixed portion which displays a local 12 hour column and a window which shows the corresponding time zones as printed on the body section. A fastening device is used for rotatably coupling the tubular sleeve to the body section.

12 Claims, 2 Drawing Sheets

10
12
14
16
18
20
22
24

CIVILIAN— MILITARY— AVIATION TIME CONVERSION DEVICE

This application claims the benefit of Provisional Application No. 60/224,535, filed Aug. 11, 2000.

BACKGROUND OF THE INVENTION

1. Field of the Invention

This invention relates to time devices and, more specifically, to a time device which is able to easily reference and convert times from different time designations.

2. Description of the Prior Art

There are currently 25 Integer World Time Zones. These zones range from −12 through 0 Greenwich Mean Time (GMT) to +12. These time zones may also referred to as Universal Coordinated Time (UTC). Each time zone is 15° longitude as measured east and west from the Prime Meridian of the world at Greenwich, England. Each time zone is generally designated with a civilian designation. The civilian designation is typically a three letter abbreviation. For example, in the United States, typical designations include Pacific Standard Time (PST), Mountain Standard Time (MST), Central Standard Time (CST), etc. There are also military designations which are based on a 24 hour clock and there are aviation conversion.

When traveling, many people are often confused by the different time zones. This is especially true for travelers on vacation. When traveling from one time zone to another, people are often unsure as to the current time.

Therefore, a need existed to provide an improved time device. The improved time device must be able to provide a convenient, efficient and simple way to reference and convert times from local time (12 hours) and local military time (24 hours) to aviation time (Zulu) and Universal Coordinated Time (UTC).

SUMMARY OF THE INVENTION

In accordance with one embodiment of the present invention, it is an object of the present invention to provide an improved time device.

It is another object of the present invention to provide an improved time device must be able to provide a convenient, efficient and simple way to reference and convert times from local time (12 hours) and local military time (24 hours) to aviation time (Zulu) and Universal Coordinated Time (UTC).

BRIEF DESCRIPTION OF THE PREFERRED EMBODIMENTS

In accordance with one embodiment of the present invention a time conversion device is disclosed. The time conversion device has a body section having a table of time zones printed thereon. A tubular sleeve is provided and fits over the body section. The tubular sleeve has a fixed portion which displays a local 12 hour column and a window which shows the corresponding time zones as printed on the body section. A fastening device is used for rotatably coupling the tubular sleeve to the body section.

In accordance with another embodiment of the present invention, a method of providing a time conversion device is disclosed. The method comprises the steps of: providing a body section having a table of time zones printed thereon; providing a tubular sleeve that fits over the body section wherein the tubular sleeve has a fixed portion which displays a local 12 hour column and a window which shows the corresponding time zones as printed on the body section; and providing a fastening device coupled to the tubular sleeve for rotatably coupling the tubular sleeve to the body section.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings, wherein like reference numerals and symbols represent like elements.

DETAILED DESCRIPTION OF THE PREFERRED EMBODIMENT

Figures 1, 2:
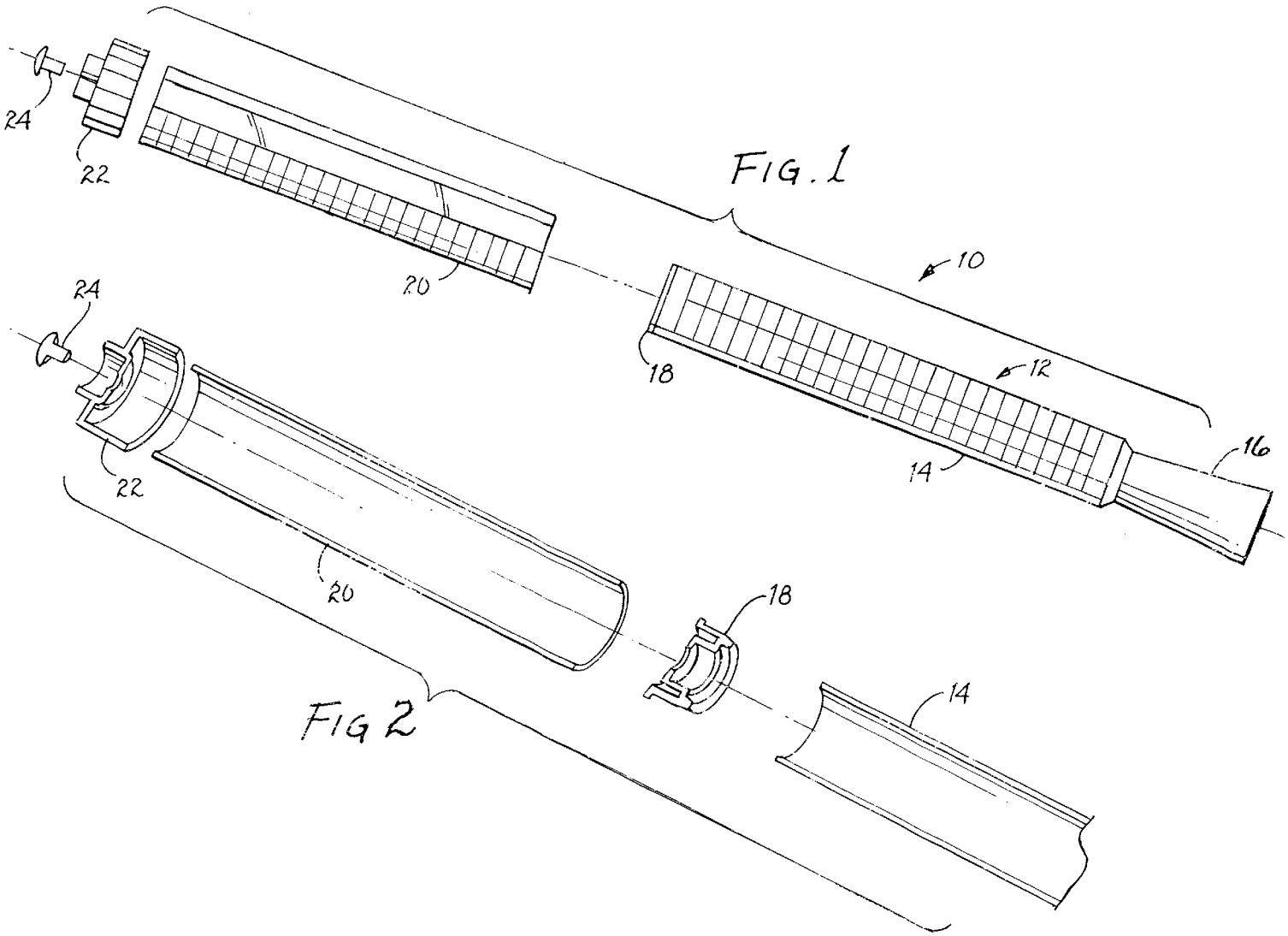
FIG. 1 is a partial exploded elevated perspective view of the Civilian—Military—Aviation Time Conversion Device of the present invention.
FIG. 2 is a cross-sectional exploded view of the Civilian—Military—Aviation Time Conversion Device of the present invention.
Figure 3:
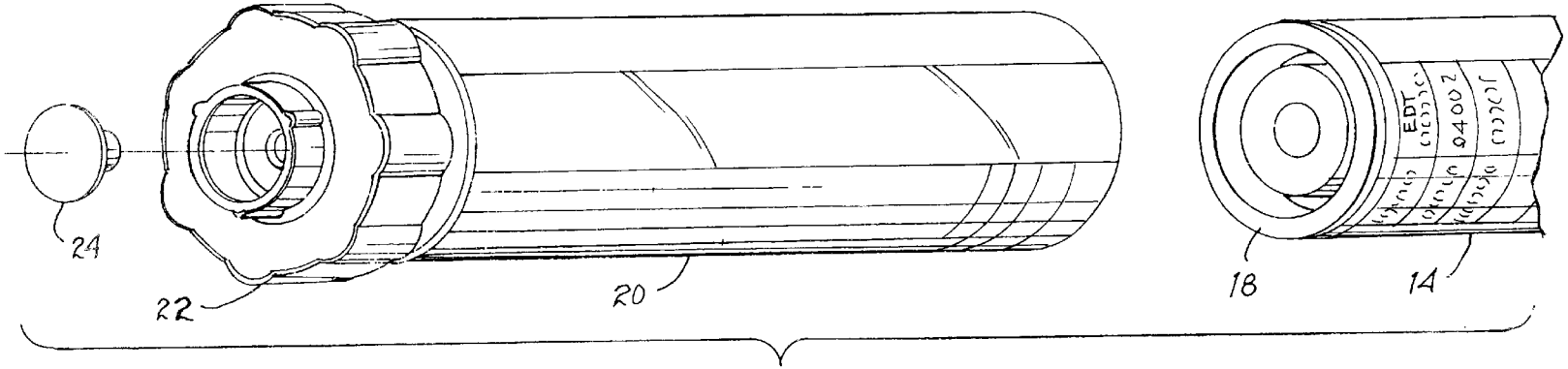
FIG. 3 is an elevated perspective view of the tubular member of the Civilian—Military—Aviation Time Conversion Device of the present invention.
Figure 4:
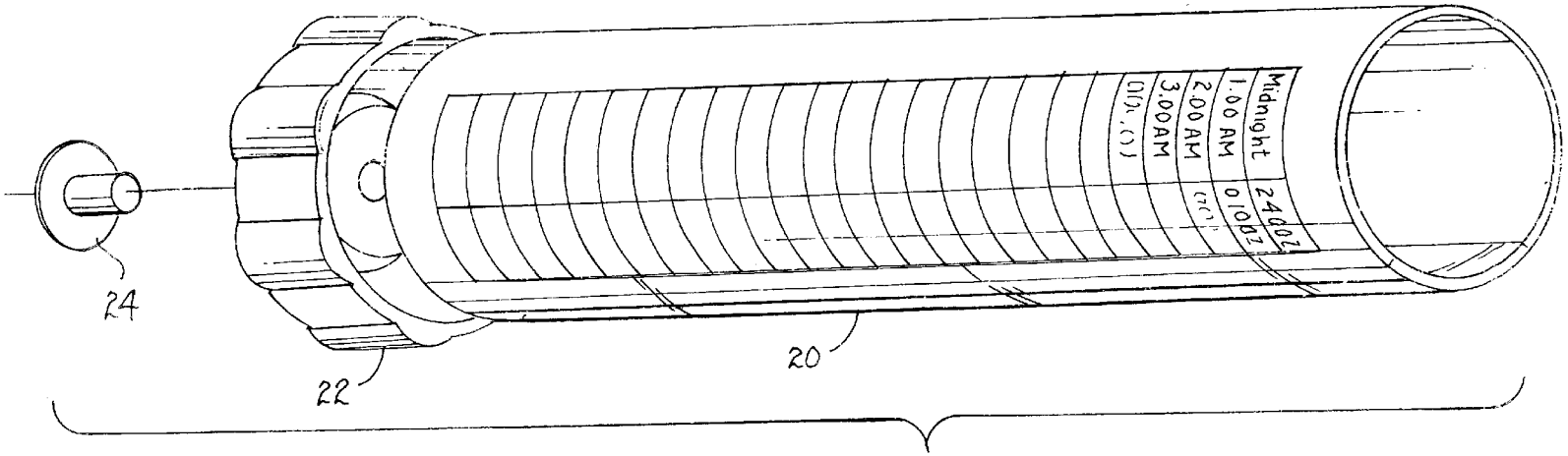
FIG. 4 is a side view of the tubular member of the Civilian—Military—Aviation Time Conversion Device of the present invention.

Referring to FIGS. 1–4 wherein like numerals and symbols represent like elements, a Civilian—Military—Aviation Time Conversion Device 10 (hereinafter time conversion device 10) of the present invention is shown. The time conversion device 10 has a main unit 12. The main unit 12 is generally a writing instrument such as a pen, a marker, a highlighter, or the like. The main unit 12 will have a body section 14. The body section 14 is used to house the internal components of the writing instruments. For example, the tube of ink and the ball point for a pen or the felt for a marker or a highlighter.

The body section 14 will have a plurality of indica on the body section. The indica may be actually written on the body section. Alternatively, the indica may be attached to the body section (i.e., a sticker). The indica will be divided and displayed in a plurality of columns. Each column will have a header. Each header will show a differing time zone. Below the header will be a listing of times (ZULU-UTC).

The main unit 12 will further have a cap section 16. The cap section 16 is located on one end of the body section 14. The cap section 16 is removable and slides on and off of the body section 14. The cap section 16 is used to cover the end of the writing instrument and protect the writing instrument from the environment. At the other end of the body section 14 is a holder 18 which is coupled thereto. The holder 18 has a circular channel along an inner circumference of the holder 18. The use of the channel will be described below.

The device 10 further has a tubular member 20. The tubular member 20 is slide over the body section 14 and will rotate around the body section 14. The tubular member 20 is transparent. The tubular member 20 is generally made of a strong light weight material like a polycarbonate. The tubular member 20 will have a fixed portion. The fixed portion will be a column(s) which will display a local 12 hour column and/or a 24 hour column. Along side these column (s) would be a window. The window is used to show the corresponding time zones (ZULU-UTC) as printed on the body section 14.

A knob 22 is coupled to the tubular member 20. The knob 22 will also be coupled to the holder 18. The knob 22 secures the tubular member 20 to the body section 14. A drive pin 24 is used to fasten and hold the knob 22 to the holder 18 of the body section 14. While the knob 22 secures the tubular member 20 to the body section 14, the knob still allows the tubular member 20 to rotate around the body section 14 for viewing of the various time zone columns as displayed on the body section 14.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A time conversion device comprising, in combination:

a body section having a table of time zones printed thereon wherein the body section is a writing instrument;

a tubular sleeve that fits over the body section wherein the tubular sleeve has a fixed portion which displays a local 12 hour column and a window which shows the corresponding time zones as printed on the body section;

a fastening device coupled to the tubular sleeve for rotatably coupling the tubular sleeve to the body section; and a cap removably coupled to the body section for protecting the writing instrument from the environment.

2. A time conversion device in accordance with claim 1 wherein the fixed portion of the tubular sleeve further displays a local 24 hour column.

3. The time conversion device of claim 1 wherein the fastening device comprises:

a holder coupled to one end of the body section;

a knob coupled to the tubular sleeve; and a drive pin for rotatably coupling the knob to the body section.

4. The time conversion device of claim 1 wherein the body section is a highlight marker.

5. The time conversion device of claim 1 wherein the tubular sleeve is made of a poly carbonate material.

6. A time conversion device comprising, in combination:

a body section having a table of time zones printed thereon wherein the body section is a writing instrument;

a tubular sleeve that fits over the body section wherein the tubular sleeve has a fixed portion which displays a local 12 hour column and a local 24 hour column and a window next to the fixed portion which shows the corresponding time zones as printed on the body section;

a fastening device coupled to the tubular sleeve for rotatably coupling the tubular sleeve to the body section wherein the fastening device comprises:

a holder coupled to one end of the body section;

a knob coupled to the tubular sleeve; and a drive pin for rotatably coupling the knob to the body section; and a cap removably coupled to the body section for protecting the writing instrument from the environment.

7. The time conversion device of claim 6 wherein the body section is a highlight marker.

8. The time conversion device of claim 6 wherein the tubular sleeve is made of a poly carbonate material.

9. A method of providing a time conversion device comprising the steps of:

providing a body section having a table of time zones printed thereon wherein the body section is a writing instrument;

providing a tubular sleeve that fits over the body section wherein the tubular sleeve has a fixed portion which displays a local 12 hour column and a window which shows the corresponding time zones as printed on the body section;

providing a fastening device coupled to the tubular sleeve for rotatably coupling the tubular sleeve to the body section; and providing a cap removably coupled to the body section for protecting the writing instrument from the environment.

10. The method of claim 9 further comprising the step of providing a fixed portion wherein the fixed portion of the tubular sleeve further displays a local 24 hour column.

11. The method of claim 9 wherein the step of providing a fastening device further comprises the steps of:

providing a holder coupled to one end of the body section;

providing a knob coupled to the tubular sleeve; and providing a drive pin for rotatably coupling the knob to the body section.

12. The method of claim 9 wherein the step of providing a tubular sleeve further comprises the step of providing a tubular sleeve made of a poly carbonate material.

* * * * *